US006746735B2

(12) United States Patent
Snedeker

(10) Patent No.: US 6,746,735 B2
(45) Date of Patent: Jun. 8, 2004

(54) PLACEMAT MEMBER

(75) Inventor: Kristen Peterson Snedeker, Leawood, KS (US)

(73) Assignee: Kiddopotamus and Company, Leawood, KS (US)

( * ) Notice: Subject to any disclaimer, the term of this patent is extended or adjusted under 35 U.S.C. 154(b) by 0 days.

(21) Appl. No.: 10/229,989

(22) Filed: Aug. 28, 2002

(65) Prior Publication Data

US 2004/0043182 A1 Mar. 4, 2004

(51) Int. Cl.[7] ..... B32B 1/02

(52) U.S. Cl. ..... 428/34.1; 428/99; 248/346.3; 248/346.01

(58) Field of Search ..... 248/346.03, 346.5, 248/346.01, 346.3, 346.11; 428/99, 34.1; 108/90; D6/613–616; 383/4

(56) References Cited

U.S. PATENT DOCUMENTS

| | | | | |
|---|---|---|---|---|
| 3,637,454 A | | 1/1972 | Pavernick | |
| 4,137,356 A | | 1/1979 | Shoemaker et al. | |
| 4,177,846 A | | 12/1979 | Rountree | |
| 4,457,964 A | | 7/1984 | Kaminstein | |
| 4,542,050 A | * | 9/1985 | Gallant | 428/34.1 |
| D316,727 S | | 5/1991 | Greenspahn | |
| 5,020,185 A | * | 6/1991 | Hoefler | 428/34.1 |
| 5,053,262 A | | 10/1991 | Kerr | |
| D326,795 S | | 6/1992 | Reitz et al. | |
| D347,360 S | | 5/1994 | Wheeler | |
| 5,712,012 A | | 1/1998 | Forman et al. | |
| 5,829,627 A | | 11/1998 | Martindale | |
| 5,875,894 A | | 3/1999 | Stromme | |
| D423,271 S | | 4/2000 | Brock | |
| 6,116,162 A | | 9/2000 | Santa Cruz et al. | |
| 2002/0017594 A1 | * | 2/2002 | DiOrio | 248/346.01 |
| 2002/0160184 A1 | * | 10/2002 | Cho | 428/343 |

OTHER PUBLICATIONS

OneStepAhead.com: Online catalog, Winter 2003: "Taby Tray", p. 11, item #01995 Jan. 2003.
OneStepAhead.com: Online catalog, Winter 2003: "Table Topper", p. 40, item #07998 Jan. 2003.
OneStepAhead.com: Website, Winter 2003: "Twingles Collapsible Stroller Tray", item #07099 Jan. 2003.

* cited by examiner

*Primary Examiner*—Alexander S. Thomas
(74) *Attorney, Agent, or Firm*—Polsinelli Shalton Welte

(57) ABSTRACT

The present invention relates to a placemat device, which is intended for use by children, whereby the placement device has a sheet member and a scoop, with the scoop designed to receive and hold the sheet member when put in a storage position. Additionally, the placemat can include indicia, which is intended for children.

9 Claims, 3 Drawing Sheets

PLACEMAT MEMBER

FIELD OF INVENTION

The present invention relates to a portable placemat that can be held or affixed to a tabletop. The placemat will have a sheet member and a scoop, whereby the scoop can receive and hold the sheet member.

BACKGROUND OF INVENTION

It is known that young children often do not use a bowl or plate from which to eat. Instead, they tend to eat with their hands off of a flat surface, such as a table. When such a surface is in the child's home, it is typically sanitary and clean, and there is little concern regarding the cleanliness of the surface from which the child is eating. However, when dining out, a parent can never be certain as to how well a table top has been cleaned. Of particular concern is the sanitary nature of a tabletop in a fast food restaurant, or similar establishment. For this reason, it is desired to have a device, or member, which can be used in a variety of settings, whereby a child can readily pick his or her food off of the tabletop without concern for sanitation.

In some respects, a paper placemat, or similar member, would suffice to ensure the sanitary nature of an eating surface. Paper, however, readily slides and does not stick or attach to the surface. For this reason, it is not well suited for use in such circumstances, because the child is likely to push the paper off the table or to degrade the paper with foods containing moisture. It is desired to have a member that can be fastened or held to a surface and not readily moved on the surface while the child is eating. Additionally, it is desired to have a member that is not susceptible to breakdown as a result of contact with water or foods that are moist.

It has been known to form a mat member made of plastic. Attached to the member are adhesive strips. Such a product is disposable and not suited for reuse. Additionally, it may not be of a sturdy enough construction. As such, it is desired to have a member that is reusable and not disposable.

Some more permanent type devices that can be fastened to a tabletop suffer from portability concerns. Such members tend to be rigid and, thus, are not easily transported. These devices may also be difficult to clean. It is consequently desired to have a member that can be readily cleaned by a parent. It is also desired to have a member that is easily portable in a diaper bag or knapsack, for example.

It is thus desired to have a member, which can be used as an eating surface for a child or adult, whereby the member can be readily fastened or held to a tabletop. It is further desired for the member to be portable. Additionally, the member should be such that it is easily cleaned, for example, by placement in a dishwasher. The member, should be reusable.

SUMMARY OF INVENTION

The present invention relates to a placemat preferably designed for use by children; however, adults may also use the mat. The placemat is designed to cover part of a surface and provide an area off of which a child may eat. As can be guessed, the product can also be used for crafts and other activities where it is desired to protect a surface and provide for easier clean-up.

The placemat has a sheet member having a top face, a bottom face, an edge, and a scoop member that is attached to the sheet member and can receive the sheet member. The scoop member can be removably or integrally attached to the sheet member. Alternatively, the scoop member can be designed as a stand-alone member designed to receive and hold the sheet member. A plurality of suction cups are optionally attached to the sheet member. An alternative to the suction cups would be any member or construction that allows the placemat to be removably held to a surface. For example, an adhesive strip could be used. Also, a material that is slip resistant and tacky could be used to form the sheet member.

The placemat can be made of a variety of materials, including rubber, flexible plastic, or rubber-like materials. The materials must be such that they are safe for children and are flexible. Any material can be used, as long as it can be cleaned, is non-toxic, and is flexible. As used herein, "rubber" will mean any material possessing these characteristics. The placemat, and especially the sheet member, can be of a variety of shapes and sizes.

Indicia shaped to form designs preferably intended for children can be included as part of the design. It is preferred to include the indicia, as this is believed to be pleasing to children, thereby making the placemat commercially desirable.

Optionally, the placemat includes at least two fold lines designed to allow folding of part of the placemat along the fold lines. More preferably, there are three fold lines. Alternatively, the placemat can be of a sufficient pliability that the sheet can fold without the need for such lines. Regardless, the placemat can be folded or rolled, and then received and held by the scoop. If the fold lines are included, preferably two of the fold lines are perpendicular to the scoop, with one fold line parallel to the scoop. The scoop can be an elongated U-shaped member with a pair of opposed side walls.

The present invention is advantageous because it provides for a sanitary surface, as well as a surface that protects the member on which it is placed. Additionally, it has a desirable design that appeals to children, and the placemat can be readily held to a surface to prevent slippage.

DETAILED DESCRIPTION

The present invention relates to a placemat 20, preferably for use by children, wherein the placemat preferably includes indicia. The indicia is designed such that it will likely appeal to a child of a young age. The placemat 20 includes a sheet member 22 and a scoop member 24, whereby the sheet member can be folded and rolled-up to be received and held by the scoop member. Additionally, it is preferred if the placemat includes a plurality of suction cups 26 for holding the placemat in contact with a surface. The placemat is best shown in FIGS. 1–3, 9, and 10.

Figure 1:
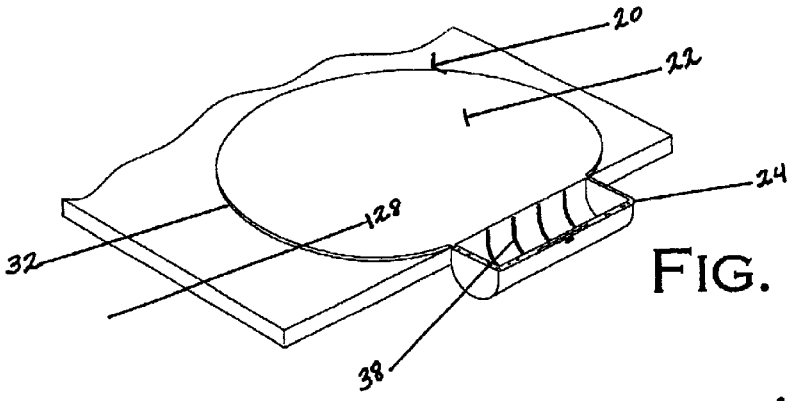
FIG. 1 is a top plan perspective view of the placemat device in use.
Figure 2:
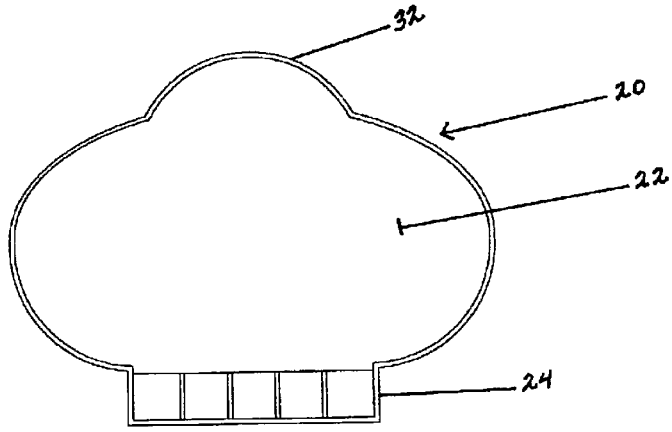
FIG. 2 is a top plan view of the placemat device.
Figure 3:
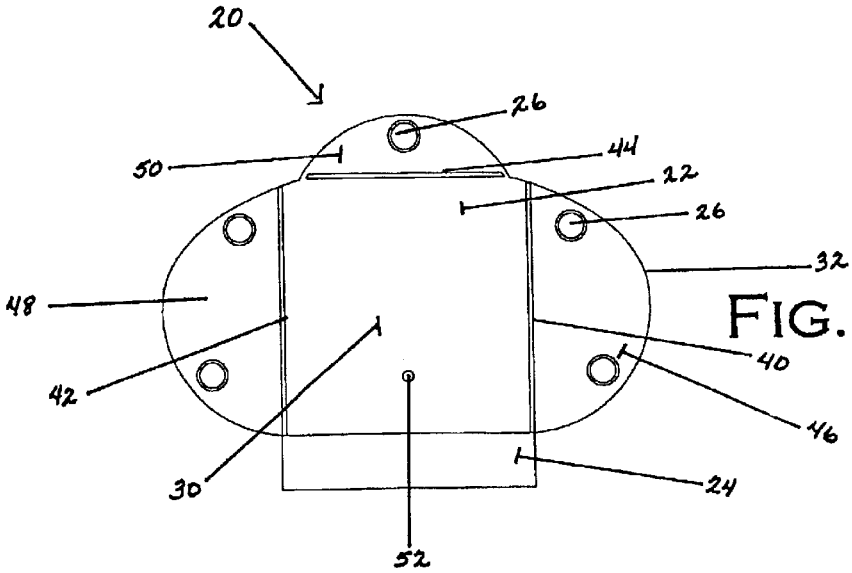
FIG. 3 is a bottom plan view of the placemat device.
Figure 10:
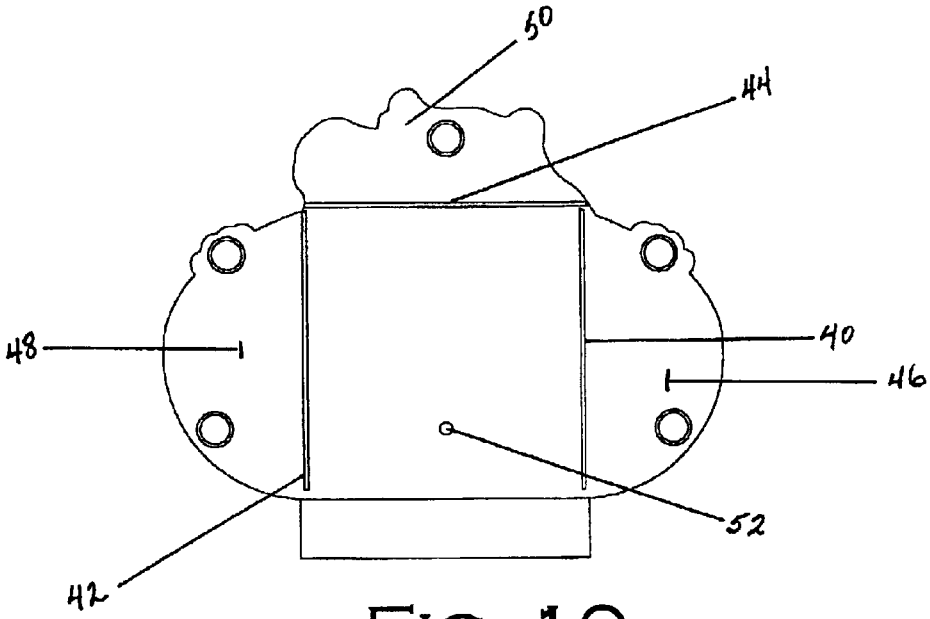
FIG. 10 is a bottom plan view of the placemat device with indicia.

The sheet member 22 will have a top face 28 and a bottom face 30, as shown in FIGS. 3 and 10, with at least one edge 32. The sheet member 22 can be of any variety of sizes and dimensions. Preferably, the sheet member will have a diameter ranging between about 24 inches and about 48 inches. Dependent upon the use, other sizes may be used. The sheet member 22 can be any of a variety of thicknesses; however, it should be of a thickness sufficient to prevent easy tearing of the material. The sheet should retain pliability so it can be folded. Any of a variety of sizes may be used, as long as the surface area provides the child with an adequate surface off of which to eat. Also, the placemat 20 size should be such that the child does not readily spread food onto the surface surrounding the placemat. Other sizes should be sufficient for arts and crafts.

Figure 6:
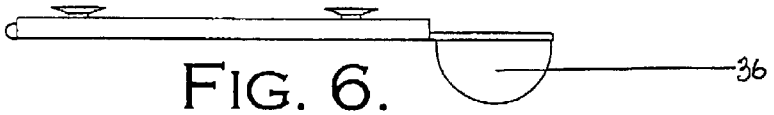
FIG. 6 is a side view of the placemat device with the member folded over.
Figure 7:
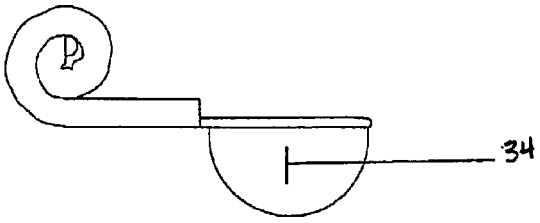
FIG. 7 is a side view of the placemat device rolled up for storage in the scoop member.
Figure 8:
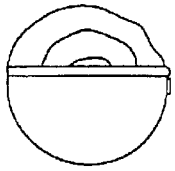
FIG. 8 is a side view of the placemat device folded into and held by the scoop member.

A scoop 24 is attached to the sheet member 22, as shown in FIGS. 1–7, to form the placemat member 20. The scoop 24 may be removably or integrally attached to the sheet member, with an integral unitary attachment preferred. In an alternative embodiment, the scoop can be a stand-alone member. Preferably, the scoop 24 is a U-shaped member having a pair of opposed side walls 34 and 36, with the scoop designed to receive the sheet member when it is rolled-up. Rolling of the sheet member and receipt by the scoop is best shown in FIGS. 7 and 8. The scoop will hold the sheet member in a rolled up position, as shown in FIG. 8, until such time as it is desired to use the placemat. Once removed, the sheet member can be unrolled into a spread out, functional position. Other shapes may be used to form the scoop 24, as long as they are of a sufficient design to readily receive and hold the sheet member 22. The scoop member will optionally include a plurality of ribs 38, shown in FIGS. 1, 2, 7, and 9, intended to strengthen or add to the rigidity of the scoop member. Preferably, the scoop is made of the same material as the sheet member. Lastly, the scoop not only receives and holds the sheet member, but the scoop will "catch" spilled materials.

A plurality of suction cups 26 will preferably be attached to the bottom face 30 of the sheet member 22. The suction cups 26 are intended to hold the placemat device 20 in place so as to ensure that the placemat does not readily move across the surface on which it is located. The suction cups can be of a variety of sizes and shapes.

Figure 4:
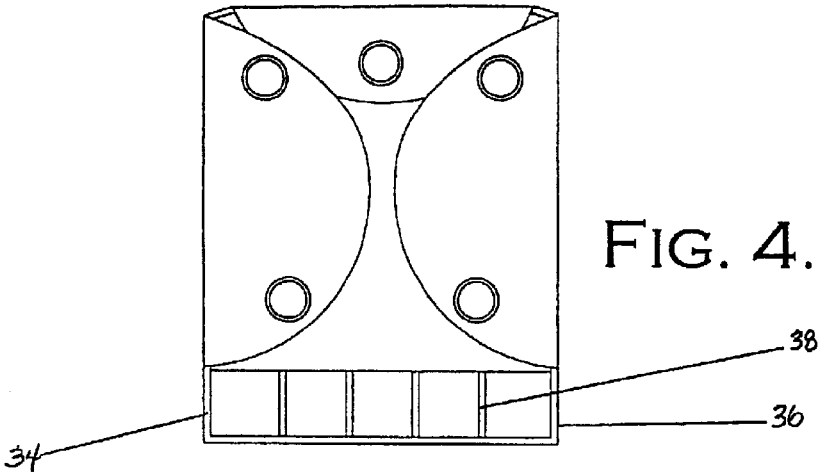
FIG. 4 is a top plan view of the placemat device showing the member folded over along the placemat fold lines.
Figure 5:
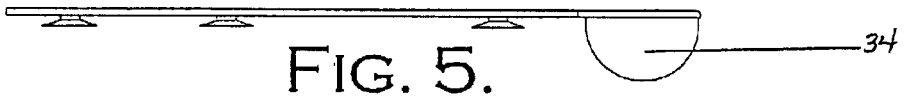
FIG. 5 is a side view of the placemat device.

The sheet member 22 will preferably include at least two folds, or scores, which will allow a portion of the sheet member to be easily folded onto the remaining portion of the sheet member. Preferably, the sheet member will have two folds 40 and 42 perpendicular to the scoop 24, and one fold 44 parallel to the scoop. Such a construction will allow the sheet member to be folded into a square or rectangular shape, as shown in FIGS. 4 and 6, and then easily rolled into the scoop member. Wings or side members 46, 48, and 50 are formed by the folds so that the wings are separated from the majority of the placemat by the folds 40, 42, and 44. Alternatively, as long as the sheet member has sufficient pliability, it will not be necessary to include the fold lines.

Attached to the placemat device will be an optional button 52, as shown in FIGS. 3 and 10, so that when the placemat device is folded into the scoop member, the button can be pulled through and received by a slit (not shown), whereby the entire placemat device will be held in a folded and rolled position, as shown in FIG. 8.

Figure 9:
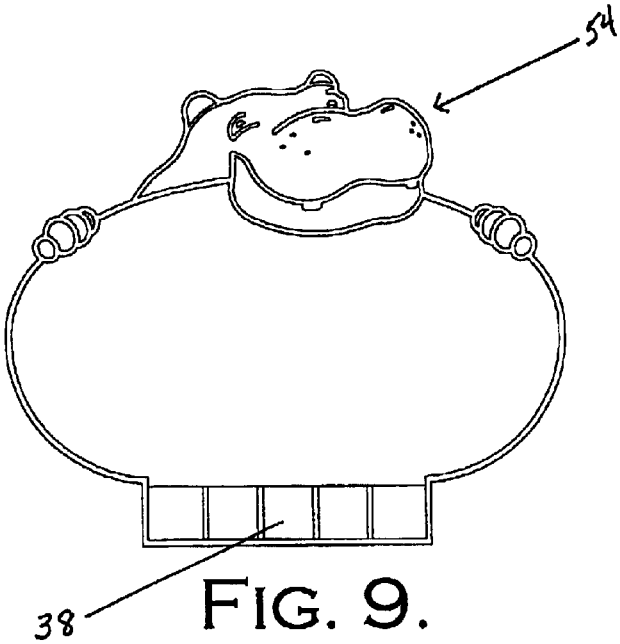
FIG. 9 is a top plan view of the placemat device with indicia.

The indicia 54, best shown in FIGS. 9 and 10, can be of any of a variety of shapes and designs. It is preferred that the indicia 54 be of a design such that cartoon-like characters are formed, as shown in FIG. 9, which are pleasing to children. Such character shapes can be of a hippopotamus, elephant, dog, cat, or similar designs.

The placemat can include a rim around the outer periphery. Such a rim is desirable to contain spilled liquids.

The placemat can be made from any of a variety of materials, including a rubber material. Materials selected should be non-toxic to humans and easily cleaned. The materials should be of a flexible nature. As such, rubber material means any composition having these characteristics. Preferably, the materials can be cleaned in a dishwasher.

Thus, there has been shown and described a placemat member which fulfills all the objects and advantages sought therefor. It is apparent to those skilled in the art, however, that many changes, variations, modifications, and other uses and applications to the placemat member are possible, and also such changes, variations, modifications, and other uses and applications which do not depart from the spirit and scope of the invention are deemed to be covered by the invention, which is limited only by the claims which follow.

What is claimed is:

1. A placemat, comprising:

(a) a sheet member having a top fare, a bottom face, an edge, and at least two fold lines;

(b) a scoop member integrally attached to said sheet member; and, (c) a plurality of suction cups.

2. The placemat of claim 1, wherein said placemat is made of rubber.

3. The placemat of claim 1, wherein said placemat includes indicia shaped to form designs intended for children.

4. The placemat of claim 1, wherein said placemat is folded, and received and held by said scoop.

5. The placemat of claim 1, wherein two of said fold lines are perpendicular to said scoop, and one fold line is parallel to said scoop.

6. The placemat of claim 1, wherein said scoop has an elongated U-shaped member with a pair of opposed side walls.

7. A placemat, comprising:

(a) a sheet member having a top face, a bottom face, an edge, and at least two fold lines;

(b) a scoop member integrally attached to said sheet member; and, (c) a plurality of suction cups.

8. A placemat, comprising:

(a) a sheet member having a top face, a bottom face, an edge, and at least two fold lines;

(b) a scoop member attached to said sheet members; and, (c) a plurality of suction cups.

9. A placemat, comprising:

(a) a sheet member having a top face, a bottom face, an edge, and at least two fold lines;

(b) a scoop member; and, (c) a plurality of suction cups.

* * * * *

UNITED STATES PATENT AND TRADEMARK OFFICE

CERTIFICATE OF CORRECTION

PATENT NO. : 6,746,735 B2
DATED : June 8, 2004
INVENTOR(S) : Kristen Peterson Snedeker It is certified that error appears in the above-identified patent and that said Letters Patent is hereby corrected as shown below:

Column 4,
Line 30, delete “fare” and insert -- face -- therefor.

Signed and Sealed this

Eighth Day of February, 2005

JON W. DUDAS
*Director of the United States Patent and Trademark Office*